US008182880B2

(12) United States Patent
Kaiser et al.

(10) Patent No.: US 8,182,880 B2
(45) Date of Patent: May 22, 2012

(54) METHODS OF MANUFACTURING FLEXIBLE INSULATED WIRES

(75) Inventors: Mark Kaiser, Prospect Heights, IL (US); Mariola Jolanta Proszowski, Des Plaines, IL (US); Alexander Bershitsky, Northbrook, IL (US)

(73) Assignee: Honeywell International Inc., Morristown, NJ (US)

( * ) Notice: Subject to any disclaimer, the term of this patent is extended or adjusted under 35 U.S.C. 154(b) by 659 days.

(21) Appl. No.: 12/361,255

(22) Filed: Jan. 28, 2009

(65) Prior Publication Data

US 2010/0189884 A1 Jul. 29, 2010

(51) Int. Cl.
*B05D 1/18* (2006.01)

(52) U.S. Cl. ..... 427/434.6; 427/434.2; 427/419.2; 427/372.2; 427/117; 118/264; 118/420; 118/DIG. 19

(58) Field of Classification Search ..... 427/430.1, 427/372.2, 402, 435; 118/208, 255, 264, 118/400, 420

See application file for complete search history.

(56) References Cited

U.S. PATENT DOCUMENTS

| | | | | |
|---|---|---|---|---|
| 2,238,575 | A * | 4/1941 | Alexay | 118/125 |
| 3,352,009 | A * | 11/1967 | De Forest et al. | 29/605 |
| 5,062,685 | A | 11/1991 | Cain et al. | |
| 5,154,954 | A | 10/1992 | Croop et al. | |
| 5,296,650 | A * | 3/1994 | Kobayashi et al. | 174/23 C |
| 6,608,757 | B1 | 8/2003 | Bhatt et al. | |
| 6,783,597 | B2 | 8/2004 | Cronk et al. | |
| 6,906,258 | B2 * | 6/2005 | Hirai et al. | 174/36 |
| 2002/0142161 | A1 * | 10/2002 | Grimes | 428/375 |
| 2008/0210453 | A1 * | 9/2008 | Kauffman | 174/110 R |

FOREIGN PATENT DOCUMENTS

EP 0578469 B1 9/1995

* cited by examiner

*Primary Examiner* — David Turocy

(74) *Attorney, Agent, or Firm* — Ingrassia Fisher & Lorenz, P.C.

(57) ABSTRACT

Methods of manufacturing insulated wires are provided. In an embodiment, by way of example only, a method includes drawing a conductive wire through a first pad to apply a layer of a first slurry onto the conductive wire, the first pad comprising a chamois leather material and including the first slurry disposed on the chamois leather material, wherein the first slurry comprises a first dielectric precursor material and a first binder having an organic component and heat treating the conductive wire to form the insulated wire.

19 Claims, 3 Drawing Sheets

METHODS OF MANUFACTURING FLEXIBLE INSULATED WIRES

TECHNICAL FIELD

The inventive subject matter generally relates to insulated wires, and more particularly relates to methods of manufacturing flexible insulated wires.

BACKGROUND

Insulated wires are used in myriad applications. For instance, insulated wires may be used to create electromagnetic devices, such as motors. In particular, the wires may form coils that are wound around a magnetic core. When current flows through the wires, a magnetic field is created which may cause the core to move and produce a force. In other cases, the insulated wires may be used as part of a sensor, such as a linear variable differential transformer. Here, the wires may make up a primary winding and a secondary winding that define a bore, and a magnetic core may be disposed in the bore. The magnetic core may be configured to move axially within the bore relative to the wound wires and cause a differential current flow through the windings.

Typically, the insulated wires are made from a conductive material that includes a coating of an insulating material. The insulating material, which may be polyimide, polytetrafluoroethylene (PTFE), polyvinyl chloride (PVC), a dielectric material, or another suitable material having insulative properties, is typically applied to the conductive material via spraying. For example, an automatic spraying system may spray the insulating material onto the conductive material. Though spraying produces adequate results, the automatic spraying system may potentially clog, which may increase system downtime and decrease productivity. Additionally, spraying may not be useful for producing insulated wires having precise coating thicknesses.

Accordingly, it is desirable to have an improved method of forming insulated wires, where the wires may be used in relatively high temperature environments (e.g., greater than about 240° C.) and may be bent into a desired shape at any time after being coated with the insulation. In addition, it is desirable for the improved method to be relatively inexpensive and simple to perform. Furthermore, other desirable features and characteristics of the inventive subject matter will become apparent from the subsequent detailed description of the inventive subject matter and the appended claims, taken in conjunction with the accompanying drawings and this background of the inventive subject matter.

BRIEF SUMMARY

Methods of manufacturing insulated wires are provided.

In an embodiment, by way of example only, a method includes drawing a conductive wire through a first pad to apply a layer of a first slurry onto the conductive wire, the first pad comprising a chamois leather material and including the first slurry disposed on the chamois leather material, wherein the first slurry comprises a first dielectric precursor material and a first binder having an organic component and heat treating the conductive wire to form the insulated wire.

In another embodiment, by way of example only, a method includes drawing a conductive wire through a first pad to apply a layer of a first slurry onto the conductive wire, the first pad comprising a chamois leather material and including the first slurry disposed on the chamois leather material, wherein the first slurry comprises a first dielectric precursor material and a first binder having an organic component, drying the conductive wire, after the step of drawing, repeating the steps of drawing and drying to produce a plurality of layers of the first slurry over the conductive wire, applying a second slurry over the plurality of layer of the first slurry, before the step of heat treating, the second slurry including comprising the dielectric precursor material, a second binder, and boron nitride, drying the second slurry, after the step of applying, and heat treating the conductive wire to form the insulated wire.

BRIEF DESCRIPTION OF THE DRAWINGS

The inventive subject matter will hereinafter be described in conjunction with the following drawing figures, wherein like numerals denote like elements.

DETAILED DESCRIPTION

The following detailed description is merely exemplary in nature and is not intended to limit the inventive subject matter or the application and uses of the inventive subject matter. Furthermore, there is no intention to be bound by any theory presented in the preceding background or the following detailed description.

Figure 1:
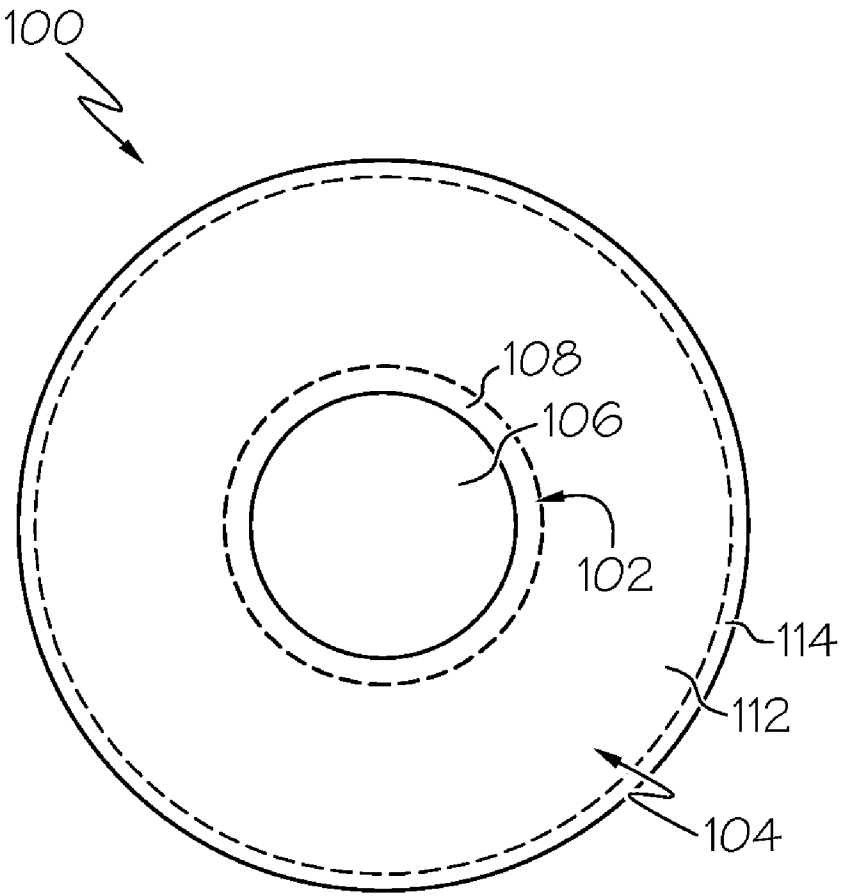
FIG. 1 is a cross-sectional view of an insulated wire, according to an embodiment.

FIG. 1 is a cross-sectional view of an insulated wire 100, according to an embodiment. The wire 100 is configured to be relatively flexible and, in this regard, is manufactured by applying a coating material over a conductive material using a chamois leather material. In an embodiment, the wire 100 has the ability to be bent around a ⅛" (3.175 mm) mandrel without demonstration of coating loss. In this regard, the wire 100 includes a conductor 102 and a coating 104. In accordance with an embodiment, the conductor 102 may include a main body 106 that is made of a first conductive material. The first conductive material may comprise any one of numerous conductive materials, such as a metal including but not limited to nickel, copper, aluminum, silver, and/or alloys thereof. In another embodiment, the conductor 102 may additionally include an outer body 108 (shown in phantom) disposed over the main body 106. In such an embodiment, the outer body 108 may comprise a second conductive material, such as one of the conductive materials mentioned above. In an embodiment, the second conductive material is different from the first conductive material, and for example, may be more or less conductive than the first conductive material. According to another embodiment, the second conductive material may have a higher or lower melting point than the first conductive material. In an example, the first conductive material may comprise copper, while the second conductive material may comprise nickel. In any case, the conductor 102 may have an average diameter in a range of from about 0.05 millimeters (mm) to about 6.5 mm, in an embodiment. In another embodiment, the conductor 102 may have an average diameter that is greater or less than the aforementioned range.

The coating 104 is disposed over at least a portion of the conductor 102. In accordance with an embodiment, the coating 104 may be formulated from a dielectric precursor material (also referred to herein as "dielectric precursor"), and a binder having an organic component that is formulated to substantially decompose during manufacture. The dielectric precursor material may comprise a material that after treatment will have a relatively low dielectric constant suitable for insulating the conductor 102. For example, the dielectric precursor material may have a dielectric constant (κ) that is less than 10. In another embodiment, the dielectric constant may be a value in a range of between about 1 and about 10. In embodiments in which the insulated wire 100 will be used in alternating current applications, the dielectric constant of the material may trend towards one (1). In another embodiment, the dielectric precursor material may be capable of insulating the conductor 102 when exposed to temperatures that may be greater than 240° C. According to an embodiment, the dielectric precursor material may include a molecular sieve material. As used herein, the term "molecular sieve material" may be defined as a porous material including substantially uniformly-sized openings (e.g., within about ±0.5 microns) with a largest diameter that is less than about 10 Angstroms. Suitable molecular sieve materials are comprised of compounds which include, but are not limited to an alumina, a silica, silica aluminate, and zeolites (such as 3A, 4A, 5A, 13x, etc), and other materials. In another embodiment, the dielectric precursor material may include other inorganic oxides, such as boron nitride. The binder may comprise an organic component that can be substantially completely decomposed when subjected to a heat treatment. In an embodiment, the organic component may include at least one polymeric component with an oxygen atom. Such an organic component may more readily decompose upon exposure to a heat treatment as compared with other types of organic components. Suitable organic components include, but are not limited to, methylcellulose, polyvinyl alcohol, polyethylene oxide, or a combination of each. In other embodiments, different dielectric materials and/or binders alternatively may be employed.

In any case, the coating 104 may comprise a single material, in an embodiment. In another embodiment, the coating 104 may comprise more than one material and may be made up of more than one portion. For example, the coating 104 may include a first portion 112 disposed over the conductor 102 and a second portion 114 (shown in phantom) disposed over the first portion 112. According to an embodiment, the first and second portions 112, 114 may comprise different coating material compositions. For instance, the first portion 112 may have a first coating material formulation that includes a first dielectric precursor material and a first binder at a first ratio, and the second portion 114 may have a second coating formulation that includes the first dielectric precursor material and the first binder at a second ratio. In another embodiment, the first portion 112 may have a first coating material formulation that includes a first dielectric precursor material and a first binder, and the second portion 114 may have a second coating formulation that includes a second dielectric precursor material and a second binder. In still another embodiment, the first portion 112 may have a first coating material formulation that includes a first dielectric precursor material and a first binder, and the second portion 114 may have a second coating formulation that includes the first dielectric precursor material and a second dielectric precursor material and the first binder. For example, the first dielectric material may include zeolite, the second dielectric precursor material may include zeolite and boron nitride, and the first binder may include polyvinyl alcohol and polyethylene oxide. In still another embodiment, the first portion 112 may have a first coating material formulation that includes a first dielectric precursor material and a first binder, and the second portion 114 may have a second coating formulation that includes the second dielectric precursor material and the first binder. In still another embodiment, the first portion 112 may have a first coating material formulation that includes a first dielectric precursor material and a first binder, and the second portion 114 may have a second coating formulation that includes the second dielectric precursor material and the second binder. In any case, the total thickness of the coating 104 (measured from an outer surface of the conductor 102 to an outer surface of the coating 104) may be in a range of from about 0.0381 millimeters (mm) [1.5 mils] to about 0.0762 mm (3 mils). In an embodiment, the thickness may be greater or less than the aforementioned range. In embodiments in which the coating 104 includes two portions (e.g., first portion 112 and second portion 114), the first portion 112 may have a thickness in a range of from about 0.0191 mm to about 0.0381 mm, and the second portion 114 may have a thickness in a range of from about 0.0191 mm to about 0.0381 mm, in an embodiment. In still other embodiments, the thicknesses of each portion may be greater or less than the aforementioned range.

Figure 2:
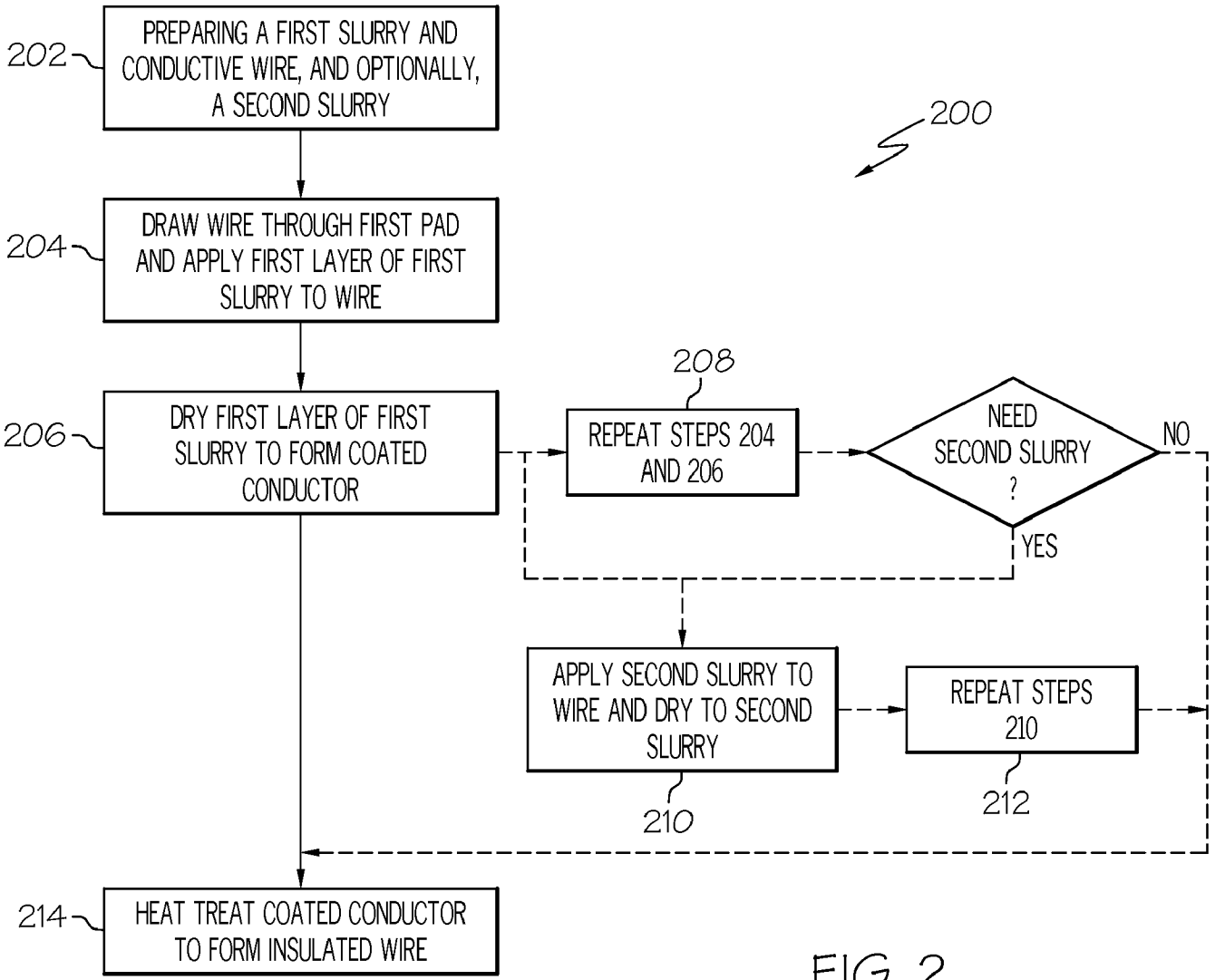
FIG. 2 is a flow diagram of a method of manufacturing an insulated wire, according to an embodiment.

To form the coating 104 on the conductor 102, a method 200 of manufacturing a flexible insulated wire depicted in FIG. 2 may be employed, in an embodiment. The method 200 includes preparing a first slurry and a conductive wire for a coating process, step 202. In an embodiment, the first slurry comprises a mixture including a dielectric precursor material and a binder. According to an embodiment, the dielectric precursor material may be selected from any one of numerous insulating materials used for the coating 104 mentioned above, and may be, for example, a molecular sieve material. The binder may comprise a material used for the coating 104 mentioned above.

The first slurry may be obtained from off-the-shelf elements, in an embodiment. However, in embodiments in which a particular particle size may be desired, the first slurry may be prepared. In such case, the dielectric precursor material and the binder material may be separately prepared. According to an embodiment, the dielectric precursor material, which may include the molecular sieve material, may undergo pre-processing and milling. In an embodiment, the molecular sieve material may be obtained as a molecular sieve powder and pre-processing may include thermally treating the molecular sieve powder in air. In accordance with an embodiment, thermally treating the molecular sieve powder may include exposing the powder to a vacuum environment and to a temperature in a range of from about 425° C. to about 475° C. for a duration of from about 5 hours to about 7 hours. In another embodiment, thermally treating the molecular sieve powder may include exposing the powder to a vacuum environment and to a temperature of about 450° C. for about 6 hours. According to another embodiment, thermally treating the molecular sieve powder may further include exposing the powder to nitrogen gas and exposing the powder to a temperature of 425° C. to about 475° C.

After the molecular sieve powder undergoes the thermal treatment process, the powder may be milled to form a milled dielectric precursor material. In accordance with an embodiment, milling, using an apparatus such as a ball mill, may be employed to obtain a uniform particle size. In an embodiment, the powder is placed in a ball mill jar with deionized water and milling beads. In one example, the ball mill jar may be a 1 liter (L) jar; however in other embodiments, the jar may be larger or smaller. According to another example, about 250 milliliters (mL) of the molecular sieve powder is disposed in the jar along with about 32 grams (g) of deionized water and 500 mL of the milling beads. In other embodiments, more or less powder, and/or water, and/or milling beads may be placed in the jar. The milling beads may comprise zirconia or another conventionally employed milling bead material. The mill jar may be placed on a mill and rotated. In an embodiment, the mill may be rotated at 30 rotations per minute (rpm) for at least 24 hours. In other embodiments, the mill may be rotated at a faster or slower pace for a longer or shorter duration.

The binder material may be prepared concurrently with the preparation of the dielectric precursor material or before or after the dielectric precursor material is prepared. In an embodiment, an amount of deionized water is disposed in a reaction kettle, and the binder material is added to the deionized water. According to an embodiment, the reaction kettle may comprise a 1 L kettle, the amount of deionized water may be in a range of from about 300 mL to about 900 mL, and an amount of the binder material added to the deionized water may be in a range of from about 5 g to about 50 g. In another embodiment, 500 mL of deionized water and 28 g of binder material may be employed. In still another embodiment, the binder material may comprise polyvinyl alcohol and polyethylene oxide, and the binder material may include about 20 grams of polyvinyl alcohol and 8 grams of polyethylene oxide. In still other embodiments, a larger reaction kettle, or more or less deionized water and binder materials may be employed. In yet other embodiments, more or less polyvinyl alcohol and/or polyethylene oxide may be included in the binder material. In another embodiment, a 0.1% to 1% addition of methylcellulose may be added to the binder material.

After the binder material and deionized water are placed in the reaction kettle, the reaction kettle may be sealed, and the contents within the reaction kettle may be stirred and subjected to heating at a temperature in a range of from about 60° C. to about 90° C. for a duration in a range of from about 2 hours to about 12 hours. In another embodiment, the contents may be heated to about 85° C. for about 3 hours. The contents are then cooled to room temperature and stirred during cooling.

The milled dielectric precursor material and the binder material are then combined and mixed together, preferably by the use of a jar mill. According to an embodiment, the milled dielectric precursor material and the binder material are disposed in a mill jar including milling beads and milled. In an embodiment, the mill jar may include about 50 mL of milling beads, an amount of the milled dielectric precursor material in a range of from about 10 g to about 15 g, and an amount of the binder material in a range of from about 80 g to about 90 g. In another embodiment, about 12 g of the milled dielectric precursor material and about 88 g of the binder material may be placed in the mill jar. In still other embodiments, more or less material may be placed in the mill jar, and the particular amounts of each may depend on a particular formulation of the first slurry that is to be employed. The mill jar is then placed on a mill and rotated. In an embodiment, the mill may be rotated at 30 rotations per minute (rpm) for at least 12 hours to form a milled first slurry. In other embodiments, the mill may be rotated at a faster or slower pace for a longer or shorter duration. The milled first slurry is then separated from the milling beads and is placed in a container and disposed on a magnetic stir plate for at least 4 hours. In another embodiment, the milled first slurry may be placed on the magnetic stir plate for a longer or shorter duration.

In accordance with another embodiment, the method 200 may also include preparing a second slurry. In one embodiment, the dielectric precursor material and the binder may be prepared as described above for the first slurry, except one or more different materials may be employed for the dielectric precursor material and/or the binder. In another embodiment, the dielectric precursor material and the binder may be prepared as described above, except in the step in which the milled dielectric precursor material and the binder material are milled, an amount of boron nitride may be added to mill jar. For example, an amount in a range of between about 0.010 g to about 0.100 g of boron nitride may be added to the mill jar. In another embodiment, about 0.012 g of boron nitride may be added to the mill jar.

As briefly mentioned above, the conductive wire may also be subjected to pre-processing. In an embodiment, the conductive wire may comprise any one of numerous conventionally-used conductive materials, such as nickel, copper, aluminum, silver, and alloys thereof. In an embodiment, the conductive wire may be a single conductor or a bundle of multiple conductors. In another embodiment, the conductor may be made up of a main body including a layer thereon. In such case, the main body may be a first conductive material, such as nickel, copper, aluminum, silver, or an alloy thereof, and may be coated with a second conductive material to form the layer. The second conductive material may be a conductive material with a higher melting point than the first conductive material. In any case, the selection of each conductive material may depend on the particular temperature environment to which the insulated wire 100 (FIG. 1) may be subjected, either during or after the manufacturing process. The conductor may either be obtained commercially, or may be formed as part of method 200.

According to an embodiment, the pre-processing step may include cleaning the conductive wire to remove oils and/or greases. Cleaning the conductive wire may also be useful to improve adhesion of the coating material to the conductive wire. In some cases, cleaning may reduce spot flaking of the coating material. In an embodiment, an aqueous cleaning solution may be employed. For example, the aqueous cleaning solution may include an aqueous alkaline cleaner. In accordance with an embodiment, the conductive wire may be soaked in the aqueous cleaning solution and rinsed with deionized water. In such case, the aqueous cleaning solution may include 12% of an aqueous alkaline cleaner, in an embodiment. In another embodiment, the aqueous cleaning solution may be heated to about 80° C. and the conductive wire may be disposed in the aqueous cleaning solution for a duration in a range of from about one minute to about 240 minutes. In still another embodiment, the conductive wire may be disposed in the aqueous cleaning solution for a duration of about 0.5 hour. In other embodiments, the aqueous cleaning solution may be heated to a higher or lower temperature and the conductive wire may be disposed in the cleaner for a longer or shorter duration. The conductive wire may be rinsed once or may be rinsed more than once. In another embodiment, the conductive wire may be pulled through a container of heated aqueous cleaning solution. In such case, the aqueous cleaning solution may include 40% of an aqueous alkaline cleaner that may be heated to about 60° C., in an embodiment. In another embodiment, the conductive wire may be immersed in the aqueous cleaning solution for a duration in a range of from about one-half minute to about 30 minutes. In still another embodiment, the conductive wire may be immersed in the aqueous cleaning solution for a duration of about 4 minutes. After the conductive wire is pulled through the container of the aqueous cleaning solution, it may be drawn through a water bath including deionized water at room temperature (e.g., 19-25° C.).

To improve adhesion of the first slurry to the conductive wire, the conductive wire may be subjected to a thermal treatment. According to an embodiment, the conductive wire may be placed in an oven and exposed to a temperature in a range of from about 400° C. to about 800° C. to form an oxide coating on a surface of the conductive wire. In other embodiments, thermal treatment may be omitted. In another embodiment, the conductive wire may be thermally treated at about 600° C. for about 5 hours.

Figure 3:
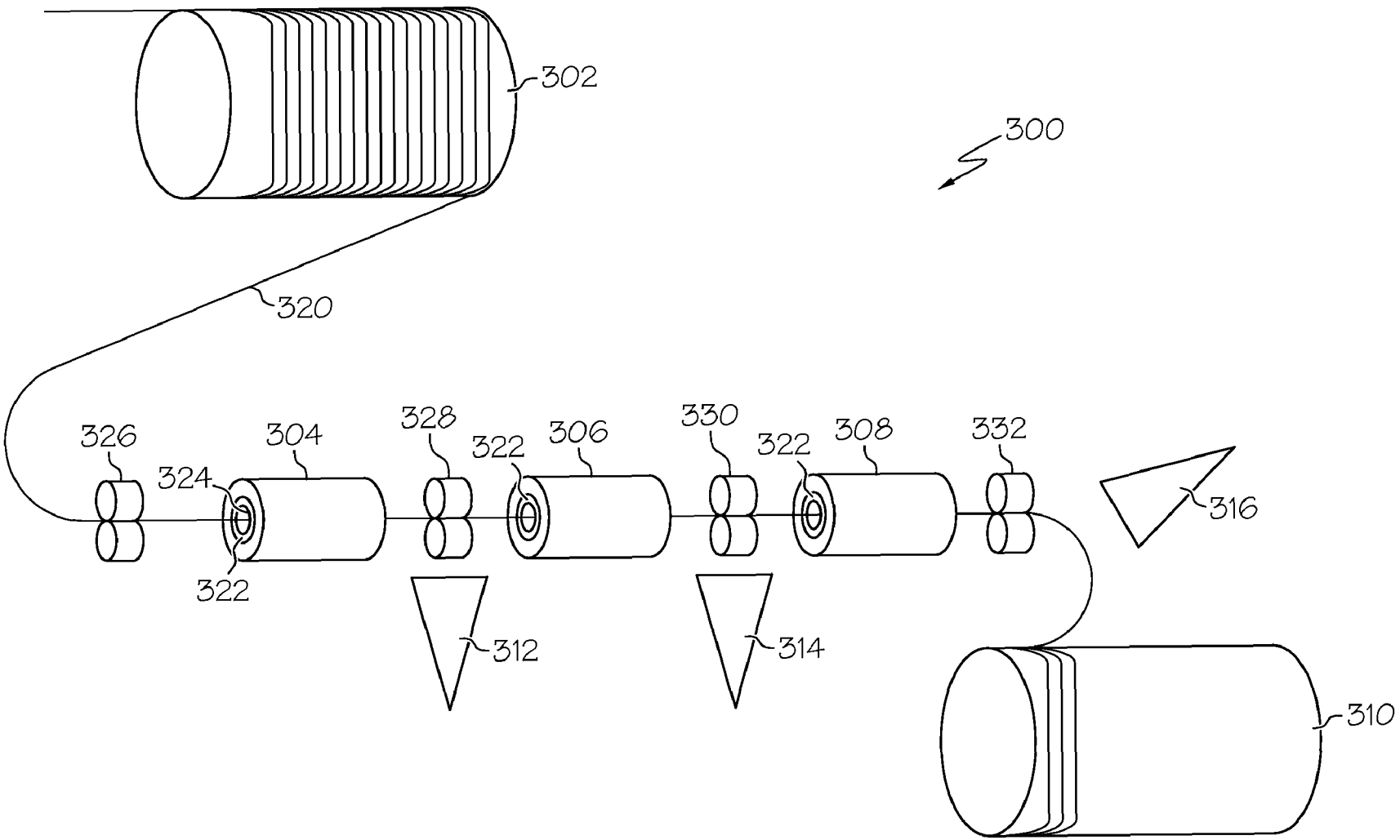
FIG. 3 is a simplified schematic of a setup that may be used for manufacturing an insulated wire, according to an embodiment.

After thermal treatment, the conductive wire may be cooled and placed in a coating apparatus. FIG. 3 is a simplified schematic of a coating apparatus 300, according to an embodiment. The coating apparatus 300 may include a first spool 302, one or more coating pads 304, 306, 308, one or more air dryers 312, 314, 316, and a second spool 310, in an embodiment. The spools 302, 310, coating pads 304, 306, 308, and air dryers 312, 314, 316 may be supported by conventional stands. The first and second spools 302, 310 may be configured such that a conductive wire 320 may be wound around the spools 302, 310. In an embodiment, the spools 302, 310 may comprise a ceramic material, wood, metal, or another material. The diameters of the spools 302, 310 may be in a range of from about 2 cm to about 10 cm. In an embodiment, the spools 302, 310 have diameters that are greater than 10 cm. In other embodiments, the diameters of the spools 302, 310 may be greater or less than the aforementioned values. According to an embodiment, the spools 302, 310 may include substantially equal diameters and are adapted to rotate at substantially the same speed. In other embodiments, the first spool 302 may be smaller in diameter than the second spool 310, and the first spool 302 may spin faster than the second spool 310. In still another embodiment, the first spool 302 may be larger in diameter than the second spool 310, and the first spool 302 spin may be varied to compensate for the spin of the second spool 310.

The one or more coating pads 304, 306, 308 are disposed between the two spools 302, 310 and are adapted to apply coating materials onto the conductive wire 320. In an embodiment, the coating pads 304, 306, 308 comprise at least a chamois leather material 322. As used herein, the term "chamois leather material" may be defined as a synthetic or natural (such as from animal) leather material that acts as a microporous membrane when exposed to water, and as a waterproof material when subjected to a hydrocarbon material, such as alkanes or polymers. As a result, if a slurry is placed over the chamois leather material 322, the particles of the slurry do not separate from the liquid of the slurry, as the chamois leather material 322 is not porous enough to separate the particle from the liquid as they would when the slurry contacted a felt, fabric, or foam. Instead, surface tension between the chamois leather material 322 and the slurry and between the slurry and the conductive wire 320 is present to thereby form a meniscus between the conductive wire 320 and chamois leather material 322. The chamois leather material 322 may have a thickness in a range of from about 1.5875 mm to about 3.175 mm, in an embodiment. In other embodiments, the thickness of the chamois leather material 322 may be thicker or thinner than the aforementioned range.

The chamois leather material 322 may be configured into a shape that surrounds the conductive wire 320 so that the conductive wire 320 may be drawn through. In this regard, the chamois leather material 322 may be folded into a tube, in an embodiment. For example, the chamois leather material 322 may be folded over one or more times to form the tube, such that it may be made up of more than one ply of material. In an embodiment, one ply of the chamois leather material 322 may be included. In another embodiment, the chamois leather material 322 may be folded or configured such that a total thickness of the coating pad 304, 306, 308 is in a range of from about 0.1 mm to about 1 cm. In other embodiments, the total thickness of may be greater or less than the aforementioned range.

In an embodiment, the tube has an inner surface diameter that is greater than a diameter of the conductive wire 320 to form a gap to thereby accommodate the chamois leather material 322 such that the material does not contact the conductive wire 320 when the conductive wire 320 is drawn through. Because the slurry can bridge the gap between surfaces of the chamois leather material 322 and an outer surface of the conductive wire 320, the distance between the chamois leather material 322 and an outer surface of the conductive wire 320 drawn through the coating pads 304, 306, 308 may be configured to control a thickness of the slurry applied to the conductive wire 320. For example, a shorter distance between the surfaces of the chamois leather material 322 and the outer surface of the conductive wire 320 allows formation of a relatively thin layer, while longer distance between the surfaces of the chamois leather material 322 and the outer surface of the conductive wire 320 allows formation of a thicker layer. To maintain the tube shape of the chamois leather material 322, a friction tube, a spring clip, clamp or other type of retention device 324 may be disposed around the chamois leather material 322. In an embodiment, the chamois leather material 322 may be attached to an inner surface of a tube-shaped structure.

Although three coating pads 304, 306, 308 are shown in FIG. 3, fewer or more pads may be included in other embodiments. In an embodiment in which fewer pads are included, the pads may be employed more than once in order to apply multiple layers to the conductive wire 320 and to thereby build up a coating having a desired total coating thickness. In another embodiment, a total number of coating pads included in the coating apparatus 300 may depend on a desired total number of layers that may be applied to the conductive wire 320. For example, in an embodiment in which eighteen layers of the first and/or second slurry material may be desired and thus, a total of eighteen coating pads may be included in the coating apparatus 300. In still another embodiment, a multiple coating pads may be included with the coating apparatus 300; however, each coating pad may be employed more than once during a single coating process, depending on a desired total number of layers that may be applied to the conductive wire 320.

In an embodiment, all of the coating pads 304, 306, 308 may include the first slurry. In another embodiment, some of the coating pads (e.g., coating pads 304 and 306) include the first slurry, and some of the coating pads (e.g., coating pad 308) include the second slurry. According to an embodiment, a majority of the coating pads (e.g., coating pads 304 and 306) may include the first slurry and a remainder of the coating pads (e.g., coating pad 308) may include the second slurry. In any case, the first and/or second slurry material may be disposed over at least the chamois leather material of the coating pads 304, 306, 308. In accordance with an embodiment, the chamois leather material may be dampened or soaked with the first and/or second slurry material by injecting, dipping, or otherwise exposing the chamois leather material to the slurry material.

The one or more dryers 312, 314, 316 may be disposed after each coating pad 304, 306, 308. In this way, the conductive wire 320 may be subjected to drying after being coated with the first or second slurry. According to an embodiment, each dryer is adapted to supply a hot air, e.g., air having a temperature that is greater than about 100° C. In accordance with an embodiment, each of the dryers 312, 314, 316 may include a nozzle and/or tubing that is in flow connection with a single air source. In other embodiments, the dryers 312, 314, 316 each may include an air source. In an embodiment, a total number of dryers 312, 314, 316 corresponds to a total number of coating pads 304, 306, 308. Thus, in an embodiment in which eighteen coating pads are included, eighteen dryers may be included as well.

One or more rollers 326, 328, 330, 332 may be employed to guide the conductive wire 320 through the coating apparatus 300 during the coating process. In an embodiment, the rollers 326 328, 330, 332 each may comprise an assembly of rollers (for example, two rollers), and the conductive wire 320 may be fed between the rollers. In another embodiment, the rollers 326, 328, 330, 332 each may comprise a single roller and the conductive wire 320 may be guided through the concave section of the roller. In still other embodiments, the rollers 326, 328, 330, 332 may have a different configuration.

With additional reference to FIG. 2, after preprocessing, the conductive wire is drawn through a first pad and a first layer of the first slurry is applied onto the wire, step 204. For example, an end of the conductive wire 320 may be fed through the spools 302, 310, coating pads 304, 306, 308, and the rollers 326, 328, 330, 332, and the end of the conductive wire 320 may be attached to the second spool 310. In accordance with an embodiment, one or both of the first and/or second spools 302, 304 may begin to spin. In an embodiment, the spinning of the second spool 304 may cause the conductive wire 320 to be pulled through the coating apparatus 300. The conductive wire 320 may be drawn through the first pad 304 of the coating apparatus 300 so that a first layer of the first slurry is applied to the conductive wire 320. In accordance with an embodiment, the first layer may have a thickness in a range of from about 0.001 mm to about 0.127 mm more preferably 0.01 mm. In another embodiment, the first layer thickness may be greater or less than the aforementioned range.

According to an embodiment, subsequent to application, the layer of the first slurry is dried to form a coated conductor, step 206. For example, the spinning of the second spool 310 may cause the conductive wire 320 to be pulled through the first pad 304, and a first dryer 312 may direct hot air onto the first layer of first slurry to thereby dry the slurry. The first layer of first slurry is dried such that an additional layer of slurry may be applied to the first layer without removing any portion of the first layer.

After step 206, the steps of drawing (e.g., step 204) and drying (e.g., step 206) may be repeated to produce a plurality of layers of the first slurry on the wire, step 208. According to an embodiment in which additional coating pads (e.g., pads 306 and 308) are included, the spinning of the second spool 310 may cause the previously coated conductive wire 320 to be pulled into the second pad 306 for application of an additional amount of the first slurry to form a second layer over the first layer. In accordance with an embodiment, the second layer may have increase the thickness in a range of from 0.001 mm to about 0.127 mm more preferably 0.01 mm. In another embodiment, the second layer thickness may be greater or less than the aforementioned range. In other embodiments, the second layer may have a thickness that is substantially equal to the thickness of the first layer. In yet other embodiments, the first and second layers may not have equal thicknesses, and the first layer may be thicker and/or thinner than the second layer. Depending on the particular configuration of the coating apparatus 300, the second layer may be dried using the first dryer 312, or in an embodiment in which more than one dryer (e.g., dryers 314 and 316) are included, the second layer may be dried using the second dryer 314.

Step 208 may be repeated one or more times, until the plurality of layers form a coating having a desired thickness. For example, the step 208 may be repeated seventeen (17) to twenty-three (23) additional times to form a total of eighteen (18) to twenty-four (24) layers of the first slurry. According to an embodiment, a total thickness of the plurality of layers of the first slurry may be in a range of from about 5 mm to about 15 mm. In another embodiment, the total thickness of the plurality of layers of the first slurry may be about 10 mm. In still other embodiments, the total thickness of the plurality of layers of the first slurry may be thicker or thinner than the aforementioned range and/or value.

As briefly indicated above, in some embodiments, a second slurry may be applied over the first slurry and the second slurry may be dried after each application, step 210. In such case, one or more of the coating pads (e.g., coating pad 306 and/or 308, etc.) disposed after the coating pad including the first slurry may include the second slurry, and the conductive wire 320 may be drawn through a second coating pad including the second slurry. For example, the spinning of the second spool 310 may cause the conductive wire 320 to be pulled into the coating pad for application of the second slurry to form one or more layers of the second slurry over the already-formed one or more layers of the first slurry. In another embodiment, the second slurry may be sprayed onto the one or more layers of the first slurry. For example, the second slurry may be disposed in an airbrush sprayer or another type of sprayer and applied onto the one or more layers of the first slurry.

In accordance with an embodiment, each layer of the second slurry may have a thickness in a range of from about 0.001 mm to about 0.127 mm, more preferably 0.01 mm. In another embodiment, the thickness of each layer of the second slurry may be greater or less than the aforementioned range. According to an embodiment, step 210 may be performed after step 206 or after step 208.

According to another embodiment, step 210 may be repeated one or more times, until the plurality of layers form a portion of the coating (e.g., second portion 214) having a desired thickness, step 212. In an example, step 210 may be repeated one (1) to eleven (11) additional times to form a total of two (2) to twelve (12) layers of the second slurry. According to an embodiment, a total thickness of the plurality of layers of the second slurry may be in a range of from about 0.0191 millimeters (mm) to about 0.127 mm. In another embodiment, the total thickness of the plurality of layers of the second slurry may be about 0.075 mm. In still other embodiments, the total thickness of the plurality of layers of the second slurry may be thicker or thinner than the aforementioned range and/or value. In other embodiments, the total thickness of the one or more layers of the second slurry may be substantially equal to, thicker, or thinner than the total thickness of the one or more layers of the first slurry. Depending on the particular process by which the second slurry is applied, e.g., by employing the coating apparatus 300 or by spraying, the layer of the second slurry may be dried using dryers. For example, the first dryer 312 may be employed, in an embodiment. In another embodiment in which additional dryers (e.g., dryers 314 and 316) are included, the layer of the second slurry may be dried using the additional dryer 314. Moreover, at any point during the steps, additional amounts of first and/or second slurries may be added to the coating pads. In an example, the slurries may be pipetted, painted, or otherwise applied to the coating pads.

In any case, in an embodiment, a desired total thickness of the coating (including the layers of the first slurry (and the second slurry, if any)) may be in a range of between about 0.025 mm to about 0.127 mm (0.001 inch to about 0.005 inch). However, it will be appreciated that any thickness may be employed, and may depend on the purpose for which the insulated wire 100 may be used. By employing a coating pad including the chamois leather material, a subsequent layer of the first and/or second slurry may be applied over an initial, dried layer of the first and/or second slurry (e.g., the first layer and/or subsequently applied and dried layers, such as a second layer, etc. in other embodiments) without removal of a substantial portion of the initial, dried layer. In particular, the chamois leather material may be useful because the particles comprising the first and/or second slurry disposed on the chamois leather material remains in solution. Thus, a subsequent application of the first and/or second slurry over a dried layer of the first and/or second slurry remains wet and adheres to the dried layer.

Next, the coated conductor is heat-treated to form the insulated wire 100, step 214. In an embodiment, the coated conductor is heat-treated after step 208 and/or after step 210 (if included). Heat-treatment may occur at a predetermined temperature for a predetermined duration to decompose substantially all of the organic component on at least an outer surface of the coated conductor and/or to cause calcination. In an embodiment, the heat treatment may occur at a temperature in a range of between about 300° C. and about 1000° C. for between about 2 and 10 hours. In an embodiment, the heat treatment may occur in a vacuum environment. In another embodiment, the heat treatment may occur in an air or oxygen containing environment. In another embodiment, the heat treatment may occur in a nitrogen environment. In any case, after the heat treatment, the resultant coating 104 is a dielectric precursor material which may be capable of being bent without cracking because microfissures form in the heat-treated dielectric precursor material when the insulated wire 100 is flexed. As a result, the insulated wire 100 may be bent into a desired shape and used for various applications in which a flexible wire may be useful.

The following example is presented in order to provide a more complete understanding of the inventive subject matter. The specific techniques, conditions, materials and reported data set forth as illustrations, are exemplary, and should not be construed as limiting the scope of the inventive subject matter.

Two methods were evaluated, in which a first two hundred foot (60.96 m) sample was prepared using a spray coating method and a plurality of second two hundred foot samples were prepared using an embodiment of the draw coating method described above. For both methods, two slurries were formed. For both slurries, a dielectric precursor material of an activated molecular sieve powder comprising 5A zeolite A having a mean pore size of 0.5 nm (referred to herein as "UOP 5A") was pre-processed by calcining at 450° C. for six (6) hours to remove residual organic material on the UOP 5A. Two hundred fifty (250) milliliters (mL) of the UOP 5A powder was placed in a 1 L ball mill jar with 32 grams (g) of deionized water, and five hundred (500) mL of zirconia milling beads were added to the mill jar. The mill jar was placed on a mill and rotated at 30 rpm for over 24 hours to yield a prepared UOP 5A material. Next, a binder material was prepared by adding 500 mL of deionized water to a heated one (1) L reaction kettle and adding twenty (20) g of polyvinyl alcohol and eight (8) g of polyethylene oxide to the deionized water. The reaction kettle was sealed and the contents in the kettle were stirred and heated to 85° C. for three (3) hours to yield a prepared binder material. Stirring continued until the prepared binder material was cooled, and the prepared binder material was transferred to a storage vessel.

An alternative first slurry was also formed using the UOP 5A, however methylcellulose was employed as an additive to the binder material. In this formulation, the UOP 5A was pre-processed as noted above. Next, the binder material was prepared as noted above and up to 1% of methylcellulose (0.28 g) was added to form the prepared binder material.

After the dielectric precursor material and the binder preparation, fifty (50) zirconia milling beads, twelve (12) g of the prepared UOP 5A material and eighty-eight (88) g of the prepared binder material were added to a ball-mill jar. The mill jar was placed on a mill and rotated at 30 rpm for over 12 hours. The milling beads were then removed from the mill jar and the mill jar was placed on a magnetic stir plate for over four hours to form a first slurry.

A second slurry was formed by adding fifty (50) zirconia milling beads, twelve (12) g of the prepared UOP 5A material, eighty-eight (88) g of the prepared binder material, and 0.012 g of boron nitride to a ball-mill jar. The mill jar was placed on a mill and rotated at 30 rpm for over 12 hours. The milling beads were then removed from the mill jar and the mill jar was placed on a magnetic stir plate for over four hours.

To prepare the first sample, the slurries were then sprayed onto a wire. In particular, about 30 mL of the first slurry was added to a jar of an airbrush sprayer. A first ten (10) foot length of a 200 foot nickel wire was sprayed with the airbrush until a diameter of about 10 mm was achieved. The airbrush was passed within four inches (101.6 mm) of the wire multiple times. Next, the airbrush sprayer sprayed a second ten foot length of the 200 foot nickel wire, where a first twelve inches of the second ten foot length overlapped with the first ten (10) foot length. Spraying was performed with the airbrush until a diameter of about 10 mm was achieved. The process was repeated for each remaining ten foot length, until the entire 200 foot nickel wire was coated. One ten foot length of the 200 foot nickel wire was sprayed with the second slurry, using the airbrush sprayer. The coated wire (identified as "Wire A") was then exposed to a heat treatment for calcination at 800° C. for about 5 hours.

To prepare the second samples, the slurries were also used in a draw coating process on three two hundred foot nickel wires. Each wire was wound on a first spool and threaded through two to six coating pads including chamois leather material. For two of the wires (identified as Wires B and C), the first slurry was added to each coating pad via a dropper and the chamois leather material was kept moist during the draw coating process. The wire was drawn through the coating pads and layers of the first slurry were formed over the wire. Heat guns were used to dry each layer after application. The process was repeated until the desired thickness of the first coating was achieved. The second slurry was applied over the first slurry and repeated until the desired thickness of the overall coating was achieved. Each coated wire was then exposed to a heat treatment for calcination at 800° C. for about 5 hours. For another one of the wires (identified as Wire D), the alternative first slurry was added to each coating pad via a dropper and the chamois leather material was kept moist during the draw coating process. The wire was drawn through the coating pads and layers of the first slurry were formed over the wire. Heat guns were used to dry each layer after application. The second slurry was applied over a desired number of layers of first slurry were formed. The coated wire was then exposed to a heat treatment for calcination at 800° C. for about 5 hours. For the Wire B, 13 layers of the first slurry were applied and 12 layers of the second slurry were applied. Wire B was subjected to two heat treatments in which calcination occurred each time. For Wire C, 11 layers of the first slurry were applied and 8 layers of the second slurry were applied. For Wire D, 14 layers of the alternative first slurry were applied and 16 layers of the second slurry were applied.

The wires manufactured by the above methods were found to be useful in relatively high temperature environments (e.g., greater than about 240° C.) and were capable of being bent to a bend radius of 3.19 mm (⅛") with improved adhesion of the coating over conventionally formed insulated wires. The improved adhesion may be attributed to the use of chamois leather material for application of the coating. In particular, because the chamois leather material does not separate particles of a slurry from an aqueous material of the slurry, the slurry may be applied without abrading (and thus, removal of) already-laid layers of the slurry. Moreover, use of the chamois leather material may improve control of an amount of and/or a thickness of each layer that is disposed over the conductive wire. In addition, the improved method may be relatively inexpensive and simple to perform.

While at least one exemplary embodiment has been presented in the foregoing detailed description of the inventive subject matter, it should be appreciated that a vast number of variations exist. It should also be appreciated that the exemplary embodiment or exemplary embodiments are only examples, and are not intended to limit the scope, applicability, or configuration of the inventive subject matter in any way. Rather, the foregoing detailed description will provide those skilled in the art with a convenient road map for implementing an exemplary embodiment of the inventive subject matter. It being understood that various changes may be made in the function and arrangement of elements described in an exemplary embodiment without departing from the scope of the inventive subject matter as set forth in the appended claims.

What is claimed is:

1. A method of manufacturing an insulated wire, the method comprising the steps of:

drawing a conductive wire through a first pad to apply a layer of a first slurry onto the conductive wire, the first pad comprising a chamois leather material and including the first slurry disposed on the chamois leather material, wherein the amount of the first slurry applied onto the conductive wire from the chamois leather material is controlled to impart the layer with a predetermined thickness, and wherein the first slurry comprises a first dielectric precursor material and a first binder having an organic component; and heat treating the conductive wire to form the insulated wire wherein the method further comprises the step of folding the chamois leather material into a tube through which the conductive wire is drawn to apply the layer of the first slurry onto the conductive wire during the step of drawing.

2. The method of claim 1, further comprising the steps of:

drying the layer of the first slurry after the step of drawing; and repeating the steps of drawing and drying to produce a plurality of layers of the first slurry on the conductive wire, the plurality of layers forming a coating having a desired thickness.

3. The method of claim 1, further comprising the steps of:

applying a second slurry over the layer of the first slurry, before the step of heat treating.

4. The method of claim 3, wherein the step of applying comprises drawing the wire through a second pad including the chamois leather material and the second slurry disposed on the second pad.

5. The method of claim 3, wherein the second slurry comprises the first dielectric precursor material, boron nitride, and the first binder.

6. The method of claim 3, wherein the step of applying comprises spraying the second slurry onto the layer of the first slurry.

7. The method of claim 1, wherein the step of heat treating comprises causing calcination of the first slurry to form the insulated wire.

8. The method of claim 7, wherein the step of calcinating comprises subjecting the wire to a vacuum environment and a temperature in a range of from about 200° C. to about 800° C.

9. The method of claim 1, wherein the dielectric precursor material comprises zeolite.

10. The method of claim 1, wherein the dielectric precursor material comprises alumina silicate.

11. The method of claim 1, wherein the first binder comprises polyvinyl alcohol, polyethylene oxide, and water.

12. The method of claim 1, wherein the first binder comprises polyvinyl alcohol, polyethylene oxide, methylcellulose, and water.

13. The method of claim 1, further comprising the step of applying the first slurry directly onto the chamois leather material prior to drawing the conductive wire through the first pad.

14. The method of claim 13, wherein the step of applying comprises one of the group consisting of dipping the chamois leather material in the first slurry and injecting the first slurry into the chamois leather material.

15. The method of claim 1, further comprising the step of disposing a retention device around the chamois leather material to maintain the tubular shape thereof after folding the chamois leather material into a tube.

16. The method of claim 15, wherein the step of disposing a retention device around the chamois leather material comprises attaching the chamois leather material to an inner surface of a tube-shaped structure.

17. The method of claim 15, wherein the step of folding the chamois leather material into tube comprises folding the chamois leather material into a tube having an inner diameter greater than the outer diameter of the conductive wire such that the inner surface of the tube is separated from the outer surface of the conductive wire by a gap, which is bridged by the first slurry during the step of drawing.

18. The method of claim 17, further comprising the step of selecting the width of the gap based upon the desired thickness of the first layer.

19. A method of manufacturing an insulated wire, the method comprising the steps of:

drawing a conductive wire through a first pad to apply a layer of a first slurry onto the conductive wire, the first pad comprising a chamois leather material and including the first slurry disposed on the chamois leather material, wherein the amount of the first slurry applied onto the conductive wire from the chamois leather material is controlled to impart the layer with a predetermined thickness, and wherein the first slurry comprises a first dielectric precursor material and a first binder having an organic component;

drying the conductive wire, after the step of drawing;

repeating the steps of drawing and drying to produce a plurality of layers of the first slurry over the conductive wire;

applying a second slurry over the plurality of layer of the first slurry, before the step of heat treating, the second slurry including comprising the dielectric precursor material, a second binder, and boron nitride;

drying the second slurry, after the step of applying; and heat treating the conductive wire to form the insulated wire wherein the method further comprises the step of folding the chamois leather material into a tube through which the conductive wire is drawn to apply the layer of the first slurry onto the conductive wire during the step of drawing.

* * * * *